US007422032B2

(12) United States Patent
Carpenter et al.

(10) Patent No.: US 7,422,032 B2
(45) Date of Patent: Sep. 9, 2008

(54) METHODS AND APPARATUS FOR AN ON-OFF CONTROLLER

(75) Inventors: Dale Carpenter, 930 N. Portland, Gilbert, AZ (US) 85234; Jason Henley, Chandler, AZ (US)

(73) Assignee: Dale Carpenter, Gilbert, AZ (US)

( * ) Notice: Subject to any disclaimer, the term of this patent is extended or adjusted under 35 U.S.C. 154(b) by 0 days.

(21) Appl. No.: 11/758,284

(22) Filed: Jun. 5, 2007

(65) Prior Publication Data

US 2007/0235082 A1 Oct. 11, 2007

Related U.S. Application Data

(62) Division of application No. 11/032,934, filed on Jan. 11, 2005, now Pat. No. 7,258,138.

(51) Int. Cl.
*F15B 13/04* (2006.01)

(52) U.S. Cl. ..... 137/596; 124/74

(58) Field of Classification Search ..... 137/596, 137/625.2, 625.25–27, 861, 872, 886; 124/73–74; 251/149.6, 151, 319, 339
See application file for complete search history.

(56) References Cited

U.S. PATENT DOCUMENTS

| | | | |
|---|---|---|---|
| 2,411,667 | A | 11/1946 | Mowrey |
| 2,904,071 | A | 9/1959 | Stein |
| 3,025,845 | A | 3/1962 | Cardia et al. |
| 4,383,552 | A | 5/1983 | Baker |
| 4,817,667 | A | 4/1989 | Hagar |
| 5,613,483 | A | 3/1997 | Lukas |
| 5,711,508 | A | 1/1998 | Schreiber et al. |
| 5,755,213 | A | 5/1998 | Gardner, Jr. et al. |
| 5,950,611 | A | 9/1999 | Lopez |
| 5,957,119 | A | 9/1999 | Perry et al. |
| 6,065,460 | A | 5/2000 | Lotuaco, III |
| 6,240,943 | B1 | 6/2001 | Smith |
| 6,405,722 | B2 | 6/2002 | Colby |

(Continued)

*Primary Examiner*—John Rivell
*Assistant Examiner*—Craig M Schneider
(74) *Attorney, Agent, or Firm*—Lethan Law Firm LLC; Lawrence Letham

(57) ABSTRACT

An on-off controller, according to various aspects of the present invention, for controlling a pressurized fluid from a provided bottle, the bottle having a poppet valve biased in a closed position, wherein the pressurized fluid flows from the bottle when the poppet valve is open, the on-off controller includes a body, a seal, a rod, and a position mechanism. The body having a cavity, an inlet, an outlet, and a vent, the inlet and the outlet having continuous fluid communication with the cavity, the vent having sealable fluid communication with the cavity. The seal having a seal bore therethrough, the seal for sealing the vent. The rod having a first bore and a second bore, the first bore in continuous fluid communication with the second bore, the rod positioned in the seal bore. The position mechanism that moves the rod to: close the vent, wherein the first bore and the second bore are positioned on a same side of the seal and the rod sealably contacts the seal; and open the vent, wherein the first bore is positioned on a cavity side of the seal and the second bore is positioned on a vent side of the seal, the rod sealably contacts the seal, whereby the pressurized fluid in the cavity exits through the first bore and the second bore to the atmosphere.

20 Claims, 8 Drawing Sheets

U.S. PATENT DOCUMENTS

| | | | |
|---|---|---|---|
| 6,474,325 | B2 | 11/2002 | Rice et al. |
| 6,539,969 | B1 | 4/2003 | Sullivan |
| 6,543,475 | B2 | 4/2003 | Colby |
| 6,675,791 | B1 | 1/2004 | Alexander et al. |
| 6,851,447 | B1 | 2/2005 | Carroll |
| 6,941,938 | B2 | 9/2005 | D'Arcy et al. |
| 6,959,703 | B1 | 11/2005 | Spurlock et al. |
| 6,983,761 | B2 | 1/2006 | Henley |
| 7,107,981 | B1 | 9/2006 | Dunn |
| 7,210,499 | B2 | 5/2007 | Carpenter et al. |
| 2001/0050076 | A1 | 12/2001 | Colby |
| 2002/0046748 | A1 | 4/2002 | Hernandez |
| 2002/0096164 | A1 | 7/2002 | Perrone |
| 2002/0104524 | A1 | 8/2002 | Reible |
| 2003/0034021 | A1 | 2/2003 | Gabrel |
| 2003/0178018 | A1 | 9/2003 | Cherry |
| 2003/0226555 | A1 | 12/2003 | Reible |
| 2004/0003848 | A1 | 1/2004 | Callies |
| 2004/0107951 | A1 | 6/2004 | D'Arcy |
| 2005/0115549 | A1 | 6/2005 | Jones |
| 2005/0115552 | A1 | 6/2005 | Dobbins |
| 2006/0000510 | A1 | 1/2006 | Henley et al. |
| 2006/0005824 | A1 | 1/2006 | Carpenter |
| 2006/0011183 | A1 | 1/2006 | Dziob |
| 2007/0157974 | A1 | 7/2007 | Carpenter et al. |
| 2007/0163661 | A1 | 7/2007 | Carpenter et al. |
| 2007/0235082 | A1 | 10/2007 | Carpenter et al. |

METHODS AND APPARATUS FOR AN ON-OFF CONTROLLER

CROSS-REFERENCE TO RELATED APPLICATIONS

This application is a divisional of and claims priority to U.S. application Ser. No. 11/032,934 by Carpenter et al. filed Jan. 11, 2005, now U.S. Pat. No. 7,258,138, incorporated by reference.

FIELD OF THE INVENTION

This invention pertains generally to methods and apparatus relating to pneumatic valves.

BACKGROUND OF THE INVENTION

Pneumatic valves find uses in a variety of situations, such as, natural gas distribution systems, pneumatic tools, and controlling the flow of pressurized air to a paintball marker. Valves may benefit from a system that reduces the force that may be required to actuate the valve and a vent that may discharge the pneumatic fluid from the system when the fluid source is shut off.

SUMMARY OF THE INVENTION

An on-off controller, according to various aspects of the present invention, for controlling a pressurized fluid from a provided bottle, the bottle having a poppet valve biased in a closed position, wherein the pressurized fluid flows from the bottle when the poppet valve is open, the on-off controller includes a body, a seal, a rod, and a position mechanism. The body having a cavity, an inlet, an outlet, and a vent, the inlet and the outlet having continuous fluid communication with the cavity, the vent having sealable fluid communication with the cavity. The seal having a seal bore therethrough, the seal for sealing the vent. The rod having a first bore and a second bore, the first bore in continuous fluid communication with the second bore, the rod positioned in the seal bore. The position mechanism that moves the rod to: close the vent, wherein the first bore and the second bore are positioned on a same side of the seal and the rod sealably contacts the seal; and open the vent, wherein the first bore is positioned on a cavity side of the seal and the second bore is positioned on a vent side of the seal, the rod sealably contacts the seal, whereby the pressurized fluid in the cavity exits through the first bore and the second bore to the atmosphere.

An on-off controller, according to various aspects of the present invention, for controlling a pressurized fluid from a provided bottle, the bottle having a poppet valve biased in a closed position, wherein the pressurized fluid flows from the bottle when the poppet valve is open, the on-off controller includes a body, a seal, a rod, and a position mechanism. The body having a cavity, an inlet, an outlet, and a vent, the inlet and the outlet having continuous fluid communication with the cavity, the vent having sealable fluid communication with the cavity. The seal having a seal bore therethrough, the seal for sealing the vent. The rod having a first bore and a second bore, the first bore in continuous fluid communication with the second bore, the rod positioned in the seal bore. The position mechanism that moves the rod, wherein the position of the rod defines operating states comprising: an on-state, wherein the poppet valve is open, the first bore and the second bore are positioned on a same side of the seal, and the rod sealably contacts the seal, wherein the vent is closed and the pressurized fluid enters the inlet; an off-state, wherein the poppet valve is closed the first bore and the second bore are positioned on the same side of the seal, and the rod sealably contacts the seal, wherein the vent is closed and the cavity maintains the pressurized fluid; and a vent-state, wherein the poppet valve is closed, the first bore is positioned on a cavity side of the seal and the second bore is positioned on a vent side of the seal, the rod sealably contacts the seal, whereby the pressurized fluid in the cavity exits through the first bore and the second bore to the atmosphere.

An on-off pressurized fluid system, according to various aspects of the present invention, comprising a paintball marker, a bottle of pressurized fluid, and an on-off controller. The bottle of pressurized fluid having a poppet valve, wherein opening the poppet valve releases pressurized a pressurized fluid from the bottle, the poppet valve biased in a closed position. The on-off controller includes a body having a cavity, an inlet, an outlet, and a vent, the inlet and the outlet having continuous fluid communication with the cavity, the vent having sealable fluid communication with the cavity, the inlet couples to the bottle, and the outlet couples to the marker; a seal having a seal bore therethrough, the seal for sealing the vent; a rod having a first bore and a second bore, the first bore in continuous fluid communication with the second bore, the rod positioned in the seal bore; and a position mechanism that moves the rod to: close the vent, wherein the first bore and the second bore are positioned on a same side of the seal and the rod sealably contacts the seal; and open the vent, wherein the first bore is positioned on a cavity side of the seal and the second bore is positioned on a vent side of the seal, the rod sealably contacts the seal, whereby the pressurized fluid in the cavity exits through the first bore and the second bore to the atmosphere.

BRIEF DESCRIPTION OF THE DRAWINGS

Implementations of the present invention will now be further described with reference to the drawing, wherein like designations denote like elements, and.

DETAILED DESCRIPTION OF EXEMPLARY EMBODIMENTS

Figure 1:
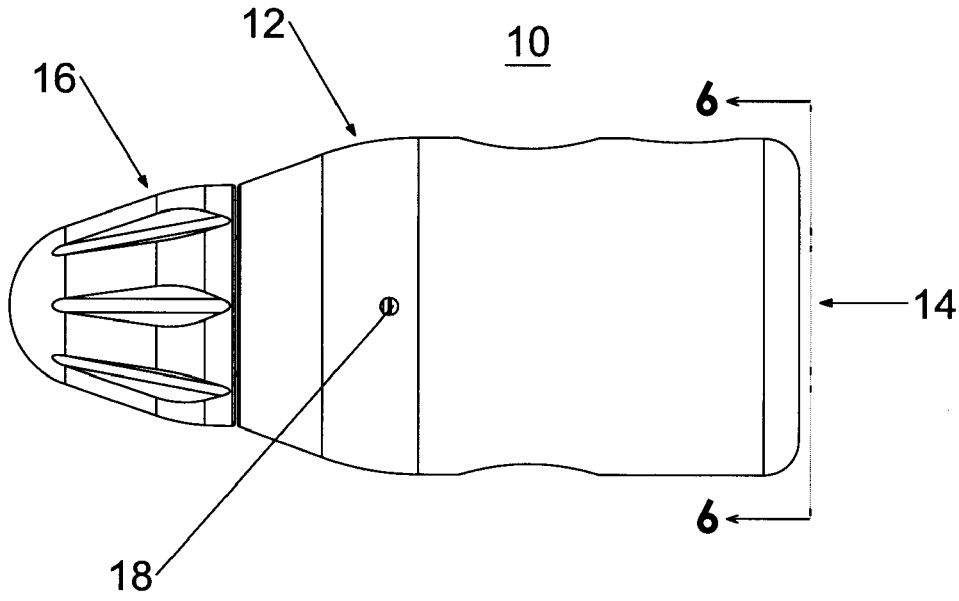
FIG. 1 is a diagram of a bottom view of an exemplary on-off controller.

The present invention is described partly in terms of functional components and various methods. Such functional components may be realized by any number of components configured to perform the specified functions and achieve the various results. For example, the present invention may be formed using a variety of materials, such as, aluminum, electroplated aluminum, steel, stainless steel, brass, titanium, iron, bronze alloy, plastic, composite materials, nanomaterials, and any other material that may be suitable for an application or environment. The present invention may be used to control the flow of any pneumatic fluid, for example, air, oxygen, natural gas, hydrogen, and so forth. The inlet may be configured to interface with any source of pressurized fluid, such as, a bottle of pressurized fluid, a fluid distribution hose, a pipe, and directly to a pneumatic compressor outlet. The outlet may be configured to interface with a device that may consume pressurized pneumatic fluid, such as pneumatic tools, a gas fireplace, and paintball markers. The outlet may connect directly to a pneumatic device or it may connect to a hose or other similar device that goes to a pneumatic device. The rod may be fashioned of any suitable material, for example, aluminum, electroplated aluminum, steel, brass, titanium, iron, composite materials, nanomaterials, and the like. The rod may be of any length and diameter suitable for a particular application or environment. The position mechanism may be formed of any suitable material and may connect to and/or move the rod in any manner appropriate for the application. For example, the position mechanism may be a lever, a crank, a knob, a screw, a magnetic device, and the like, which may carry out a variety of functions. The seals may be fashion of any suitable material, for example, plastic, Teflon, butyl, polymer, urethane, fluorocarbon polymer material, polycarbonate, polyethylene, polypropylene, polyvinylchloride, and the like. The seals may have any shape suitable for an application and may be mounted in any suitable manner. The seals may interact with the rod in any manner suitable for the operation of the on-off controller. The on-off controller may assume any operational state, for example, off, off-locked, on, on-locked, vent, vent-locked, and the like to achieve any suitable result.

In addition, the present invention may be practiced in conjunction with any number of applications and environments, and the systems described are merely exemplary applications of the invention. Further, the present invention may employ any number of conventional techniques for manufacture, testing, connecting, mounting, and repair.

Methods and apparatus according to various aspects of the present invention comprise an on-off controller configured to control the flow of pressurized pneumatic fluid. For example, a source of pressurized fluid may be a bottle having a poppet valve configured to release pressurized fluid from the bottle outlet when the poppet is depressed. An on-off controller inlet may connect to the bottle outlet. A rod, positioned in the valve body, may be configured to depress the bottle poppet valve to allow pressurized fluid from the bottle outlet to enter the on-off controller inlet, pass through the on-off controller body, and out an on-off controller outlet. A position mechanism may move and/or control the position of the rod. The on-off controller may be placed in an on-state by moving the rod such that it depresses the bottle poppet; thereby starting the flow of pressurized fluid. The on-off controller may be placed in an off-state by moving the rod away from the bottle poppet such that the poppet is no longer depressed; thereby stopping the flow of pressurized fluid. Moving the rod past the off-state position may place the on-off controller in a vent-state where pressurized fluid in the body and/or in any cavity connected to an on-off controller outlet exits to the atmosphere. In the vent-state, the on-off controller may be more easily removed from the bottle. The on-off controller method and apparatus may be used for any suitable purpose or combination of purposes, such as controlling the flow of pressurized fluid to a paintball marker, a spray painter, injection molding equipment, an air horn, a gas stove, or any other suitable application.

Figure 2:
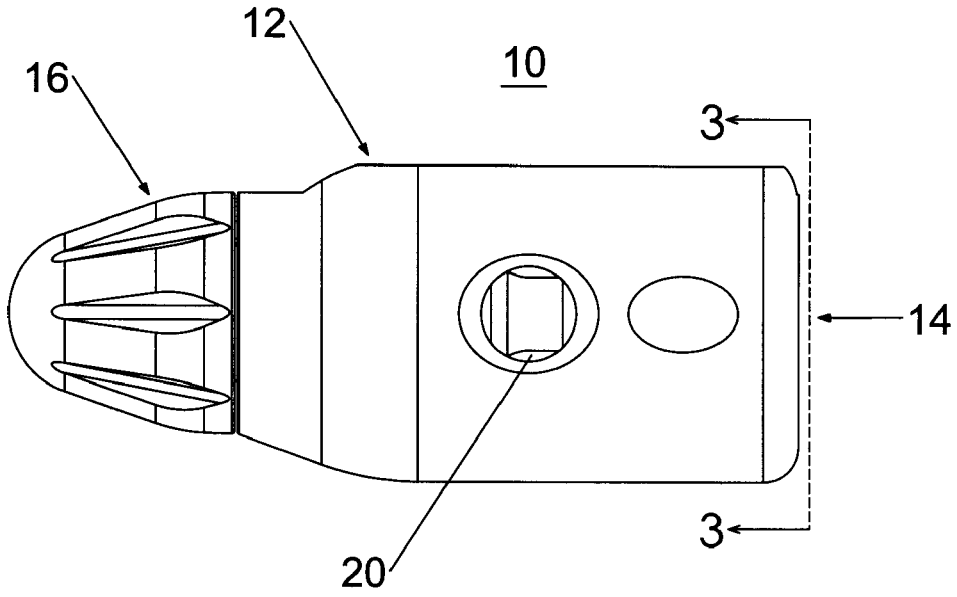
FIG. 2 is a diagram of a side view of an exemplary on-off controller.
Figure 3:
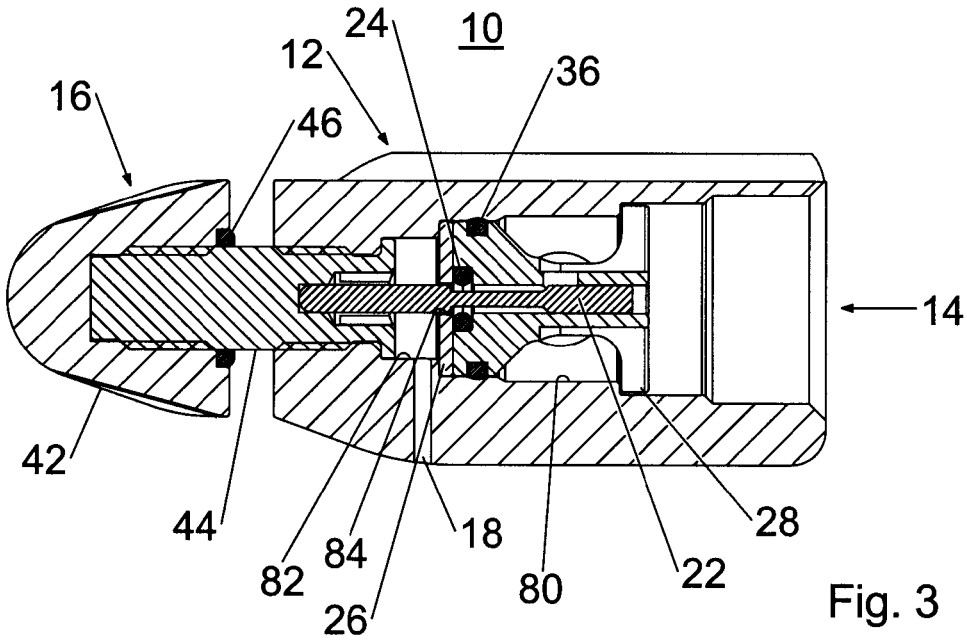
FIG. 3 is a cross-section diagram of the exemplary implementation of FIG. 2 taken along the line 3-3 with the rod in the vent-state.

In particular, referring to FIGS. 1-3, an on-off controller 10 according to various aspects of the present invention comprises a body 12 having an inlet 14, at least one outlet 20, a vent 18, a rod 22 positioned axially in the body 12, a position mechanism 16 configured to move the rod 22 axially, and a seal 24, wherein the position of the rod 22 may define operating states such as an on-state, an off-state, and a vent-state.

Figure 5:
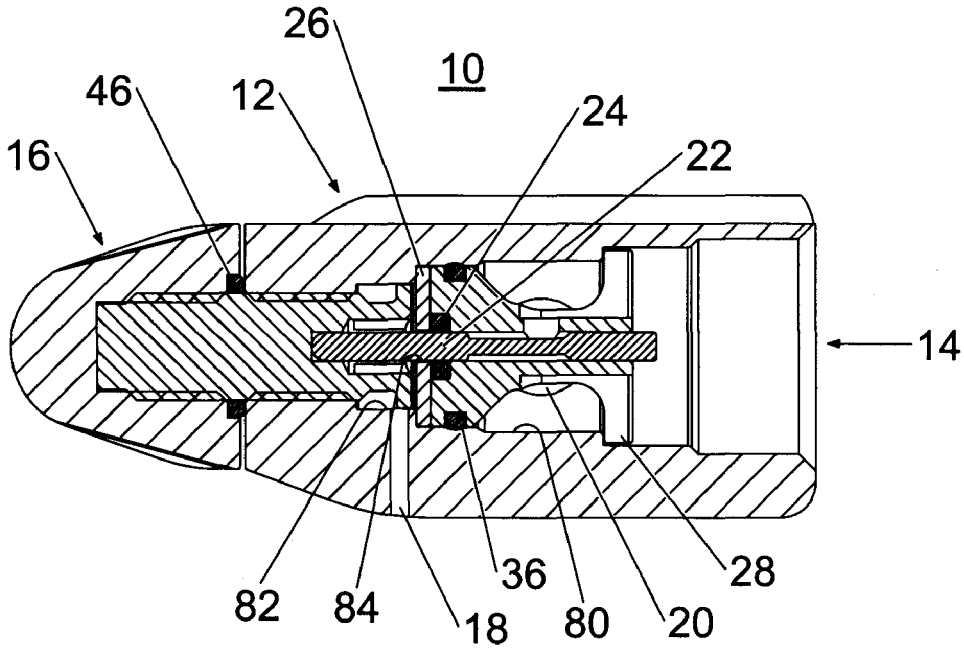
FIG. 5 is a cross-section diagram of the exemplary implementation of FIG. 2 taken along the line 3-3 with the rod in the on-state.

The on-state, referring to FIG. 5, may occur when the position mechanism 16 moves the rod 22 into contact with the poppet 1802 of a pressurized bottle 1804. Depressing the bottle poppet 1802 may allow the release of pressurized fluid into the inlet 14 where a body cavity 80 may be filled and pressurized fluid may then exit through outlet 20.

Figure 4:
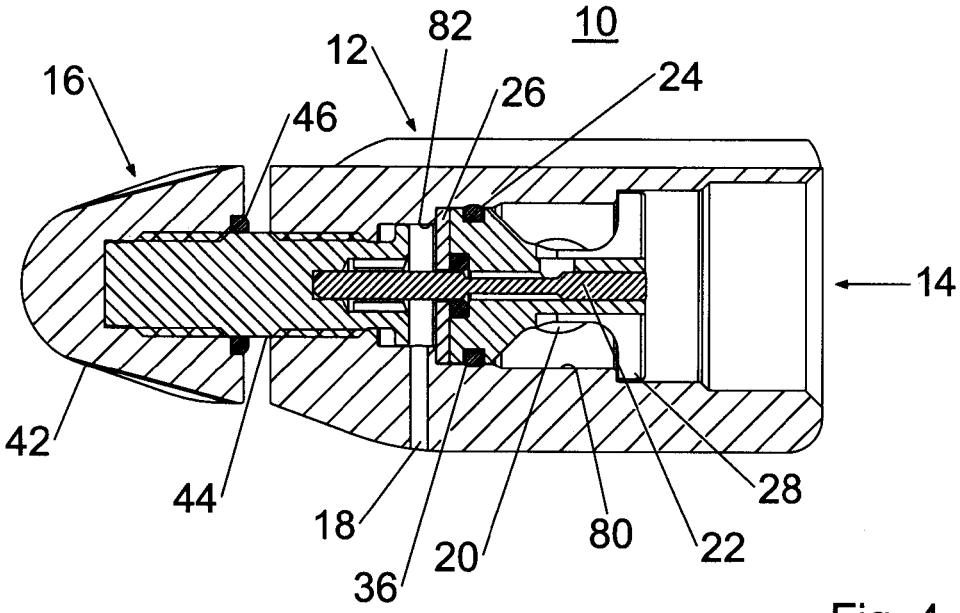
FIG. 4 is a cross-section diagram of the exemplary implementation of FIG. 2 taken along the line 3-3 with the rod in the off-state.

The off-state, referring to FIG. 4, may occur when the position mechanism 16 moves the rod 22 away from the bottle poppet 1802; thereby stopping the flow of pressurized fluid into the body cavity 80. In the off-state, when the device connected to the outlet 20 does not consume any fluid, pressurized fluid remains in the body cavity 80 because the seal 24 blocks a vent passage 84 to a vent cavity 82 and a vent 18.

The vent-state, referring to FIG. 3, may occur when the position mechanism 16 moves the rod 22 into a position where the vent passage 84 is open. When the vent passage 84 is open, pressurized fluid from the body cavity 80 and any cavities connected to outlet 20 exits through vent passage 84 into vent chamber 82 and out vent 18 to the atmosphere.

The body 12 may be of any material, shape, size, and configuration for an application or environment. The body 12 may use any material or combination of materials suitable for an application, for example, at least one of aluminum, electroplated aluminum, steel, stainless steel, brass, titanium, iron, copper, zinc, composite materials, and nanomaterials. The body 12 may be formed of a single piece of material or of multiple assembled pieces. In one implementation, referring to FIGS. 3, 8-10, a body 12 formed of multiple pieces may comprise an outer shell 30 having axial bores of different diameters, a rod mount 28 configured to position the rod 22 axially in the outer shell 30, and a seal ring 26 configured to hold seal 24 in position in rod mount 28 such that seal 24 may form sealable contact with rod 22. A rod bore 34 may be configured to moveably position rod 22 axially in body 12. Bleed hole 32 may be configured to allow the escape of pressurized fluid from body cavity 80 through rod bore 34 past seal 24, through vent passage 84, into vent cavity 82, and out vent 18 to the atmosphere when the rod 22 is in the vent-state position.

Figure 7:
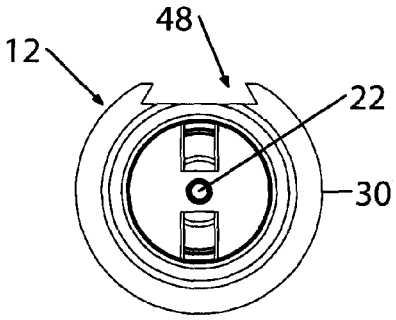
FIG. 7 is a diagram of an end view into the inlet of an exemplary on-off controller.
Figure 8:
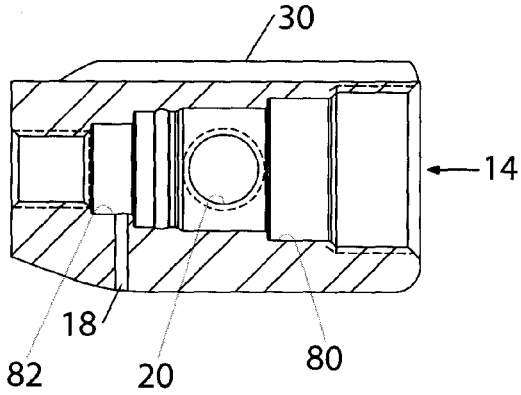
FIG. 8 is a cross-section diagram of an exemplary outer shell of the exemplary implementation of FIG. 2 taken along the line 3-3.
Figure 9:
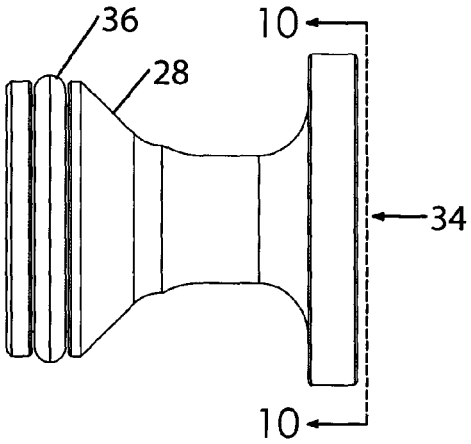
FIG. 9 is a diagram of a side view of an exemplary implementation of a rod mount.

A rod mount seal 36 may define the fluid boundary between the body cavity 80 and the vent cavity 82. Rod mount seal 36, outer shell 30, seal ring 26, and rod mount 28 cooperatively seal body cavity 80 such that pressurized fluid does not escape from body cavity 80 into vent cavity 82 except in the vent-state where seal 24 does not seal the vent passage 82. The rod mount seal 36 may additionally assist in securing rod mount 28 in outer shell 30. Outer shell 30, rod mount 28, and seal ring 26 may be made of the same or different materials. Body 12 may be configured to be connected to any suitable device in any manner suitable for the application. For example, the body 12 may connect to any suitable object by welding, bolting, clamping, gluing, and any other suitable manner. In one implementation, referring to FIG. 7, body 12 may have a groove 48 configured to accept a rail, for example, a standard paintball marker connecting rail. A rail may be placed in groove 48 and secured to body 12. In one implementation, the sides of groove 48 angle into the groove at an angle of about 60 degrees. The depth of the groove is about $^{100}/_{1000}$ of an inch. The width of the groove at its narrowest is about $^{45}/_{1000}$ of an inch and at its widest is about $^{565}/_{1000}$ of an inch.

Inlet 14 may connect to a source pressurized fluid in any suitable manner. For example, inlet 14 may connect to a source using a quick connect coupler, a screw connection, a press fit connection, a clamp connection, and any other type of connector suitable for the application. In one implementation, the inlet 14 threadedly connects to a bottle of pressurized fluid. In another implementation, the inlet 14 threadedly connects to a bottle using a ½-14 NPSM thread. The inlet 14 may be positioned at any location on the body 12. In one implementation, the inlet 14 may be positioned axially to the rod 22 which may be mounted in rod mount 28, which is positioned axially in outer shell 30.

Body 12 may have at least one outlet 20. Each outlet 20 may be positioned at any location on body 12. In one implementation, at least one outlet 20 is positioned substantially perpendicular to the axis of body 12. Each outlet 20 may connect in any suitable manner to any type of device that uses pressurized fluid. For example, each outlet 20 may connect to a pneumatic device using at least one of a quick connect coupler, a screw connection, a press fit connection, a clamp connection, and any other type of connector suitable for an application.

In one implementation, each outlet 20 may connect to a hose fitting in a threaded manner. In another implementation, the hose fitting connects to each of the outlets 20 using a ⅛" NPT thread and the hose connects to the fitting using a push-lock connection. Fluid communication between inlet 14 and each of the outlets 20 may be established in any manner. In one implementation, inlet 14 is in constant fluid communication with each outlet 20 through body cavity 80. In another implementation, inlet 14 has fluid communication with at least one outlet 20 only in the on-state. In another implementation, inlet 14 has fluid communication with at least one outlet 20 only in the on-state and the off-state.

Rod 22 may be of any length and material suitable for a particular application or environment. The rod 22 may be configured to activate and/or deactivate the flow of pressurized fluid into the inlet 14 in any suitable manner, for example, the rod 22 may control fluid flow through physical contact, magnetic activation, light activation, electrical activation, heat, vibration, and any other manner suitable for the configuration.

In one implementation, a bottle of pressurized fluid 1804 connects to inlet 14. Fluid flow from the bottle 1804 is controlled by a poppet valve 1802 at the outlet of the bottle 1804. Depressing the poppet 1802 enables pressurized fluid to flow from the bottle 1804 into the inlet 14. The poppet valve 1802 may be resiliently urged into a closed position where the poppet 1802 is in a non-depressed position. Decreasing the pressure the rod 22 exerts on the poppet 1802 may enable the poppet 1802 to move to the closed position; thereby stopping the flow of pressurized fluid from the bottle 1804 into the inlet 14. The movement of the poppet 1802 into the closed position may also move rod 22 into the off-state position. The position of rod 22 controls the poppet 1802 position and therefore the flow of pressurized air.

In one implementation, the rod 22 may be positioned axially to the poppet such that axial movement of rod 22 may depress or release the poppet thereby enabling or disabling, respectively, the flow of pressurized fluid from the bottle into outlet 14. In another implementation, the rod may be positioned to one side of the poppet and may be shaped in such a manner that movement of the rod 22 across the poppet causes the poppet to be depress and movement away from the poppet enables the poppet to return to its closed position.

Rod 22 may have any shape and/or diameter suitable for a particular application or environment. For example, the rod 22 may be cylindrical with substantially equal diameter along its length, substantially cylindrical with varying diameter along its length, and substantially rectangular. In one implementation, the diameter of rod 22 is substantially similar at each end and may decrease at a distance away from each end. In one implementation, the rod 22 diameter gradually decreases from a larger diameter at each end to a smaller diameter substantially nearer the middle.

Figure 10:
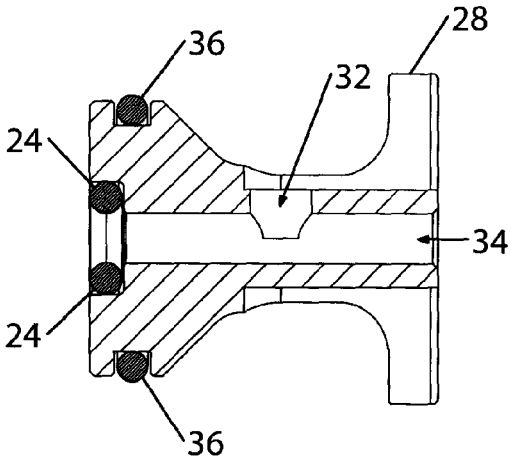
FIG. 10 is a perspective cross-section diagram of the exemplary implementation of FIG. 9 taken along the line 10-10.
Figure 14:
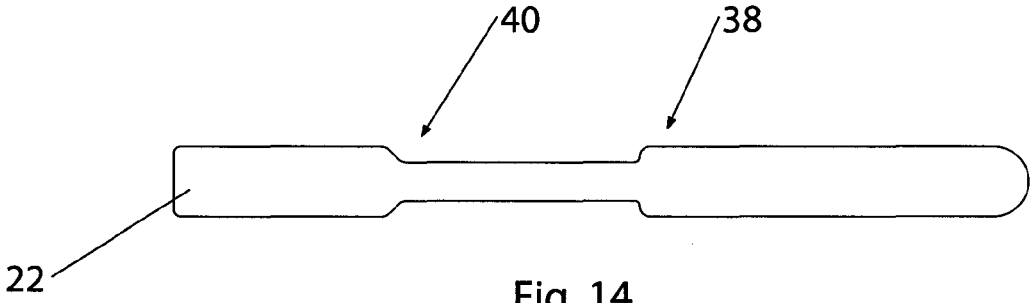
FIG. 14 is a diagram of a side view of an implementation of the rod shown in FIGS. 3-6.
Figure 15:
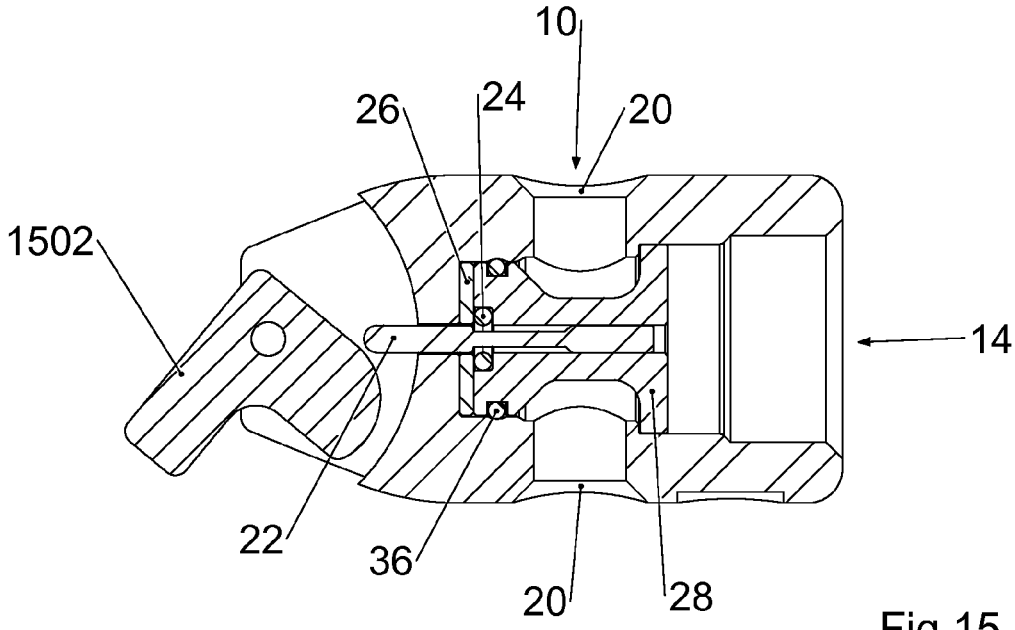
FIG. 15 is a cross section diagram of an on-off controller, according to various aspects of the present invention, with a rod in a vent-state.
Figure 16:
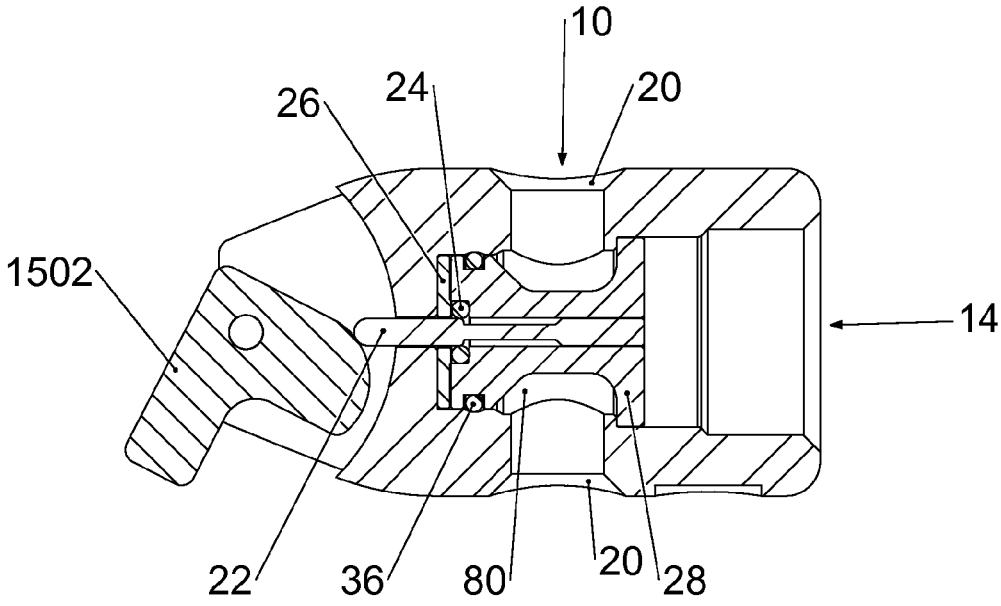
FIG. 16 is the on-off controller of FIG. 15 with the rod in the off-state.
Figure 17:
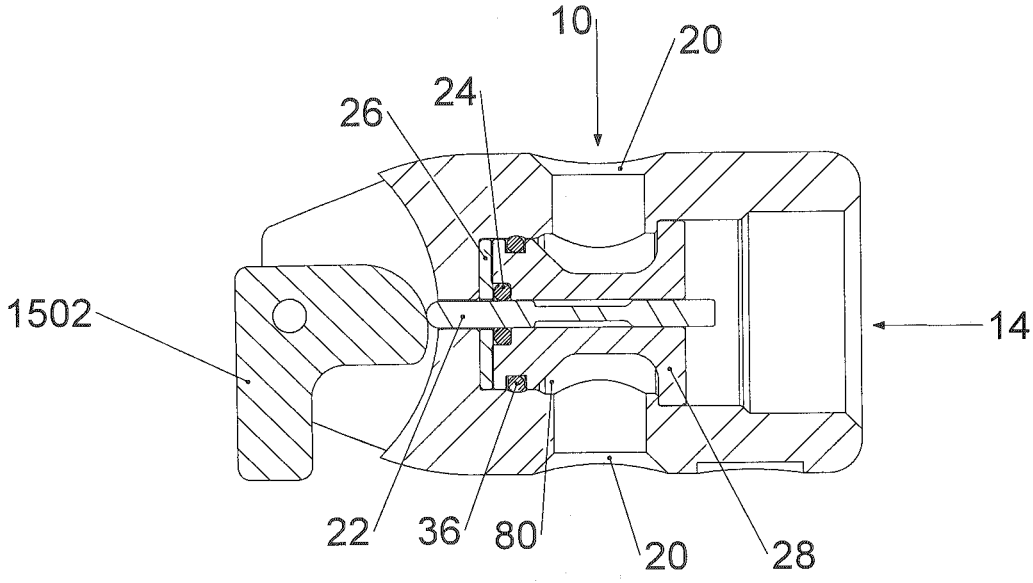
FIG. 17 is the on-off controller of FIG. 15 with the rod in the on-state.
Figure 18:
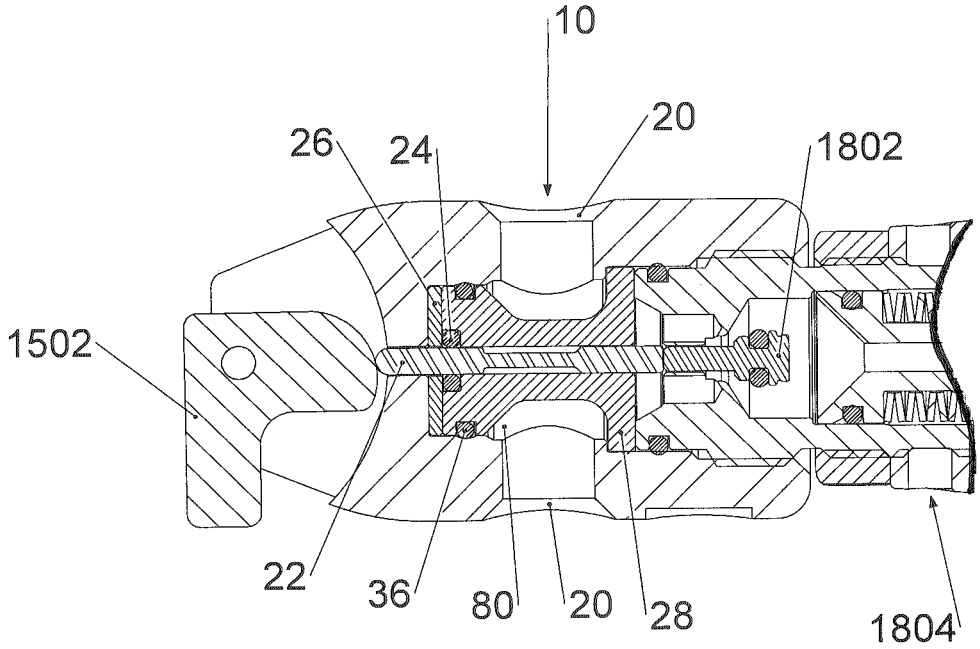
FIG. 18 is the on-off controller of FIG. 15 coupled to a bottle.
Figure 19:
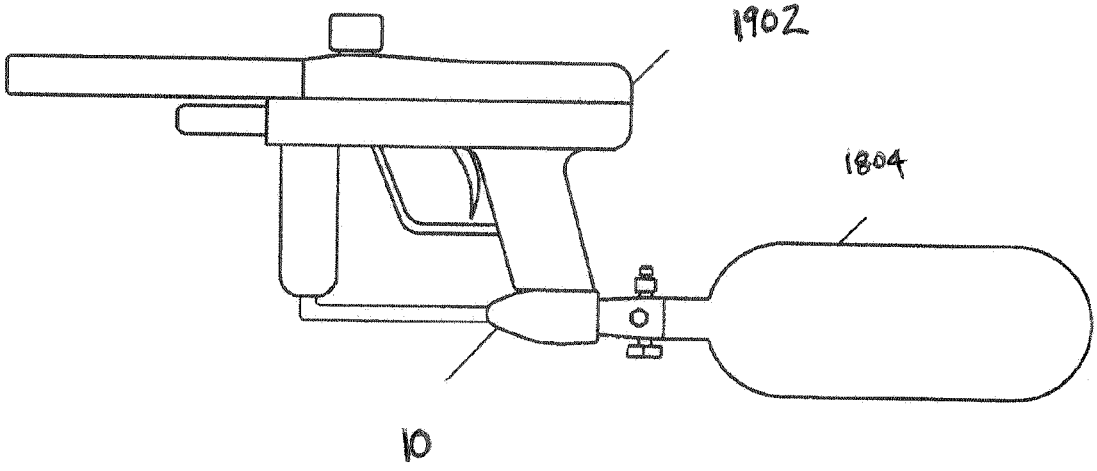
FIG. 19 is an on-off controller coupled to a bottle and a paintball marker.

The decrease in diameter from one end may be substantially symmetrical to the decrease from the other end. A symmetrical decrease in diameter may decrease the force required to move the rod from one position to another position when pressurized fluid is in the body 12. Referring to FIGS. 5 and 10, in the on-state, pressurized fluid may enter bleed hole 32 and exert force on rod 22. A symmetrical decrease in diameter, referring to FIG. 14, may substantially equalize the force exerted by the pressurized fluid against the surface of rod 22 at point 38 and 40; therefore, the force from the pressurized fluid on the rod 22 may not substantially increase the force required to move the rod in either direction. An asymmetrical decrease in area may leave more surface area on one part of the rod 22 exposed to the force of the pressurized fluid. The force of the pressurized fluid against the larger surface area may be greater than the force against the lesser surface area; thereby, making it more difficult to move the rod 22 in one direction, but not in the other.

In one implementation, the rod 22 diameter at the ends is configured to be the diameter best suited to depress a poppet on a bottle of pressurized fluid. The diameter of the rod 22 away from the ends is decreased symmetrically to reduce and/or equalize the amount of force exerted by the pressurized fluid on the surface of the rod and to break the seal between seal 24 and the larger diameter of the rod 22 when the rod 22 is in the vent-state position as shown in FIG. 3. When the seal between seal 24 and rod 22 is broken, pressurized air from body cavity 80 may pass through vent passage 84 into vent cavity 82, and out vent 18.

Figure 11:
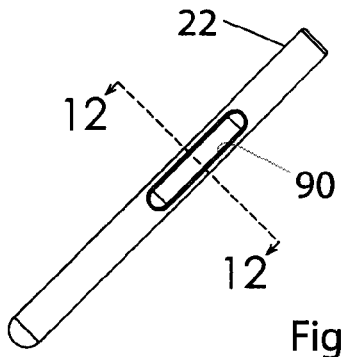
FIG. 11 is a perspective diagram of an implementation of the rod.
Figure 12:
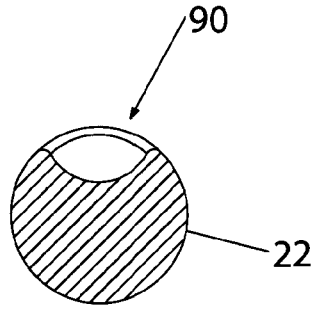
FIG. 12 is a cross-section diagram of the implementation of the rod of FIG. 11 taken along the line 12-12.

In another implementation, the rod 22 may have a constant diameter its entire length, but be hollow at certain points and have holes in the rod 22 that lead to the hollow sections to allow venting. In one implementation of the rod 22, referring to FIGS. 11 and 12, the rod 22 has a constant diameter with groove 90 in a portion of the length to allow venting. Rod 22 seals the vent when the groove is positioned on a same side of seal 24 and rod 22 sealably contacts seal 24. Rod 22 unseals the vent when groove 90 straddles seal 24 thereby breaking sealable contact between rod 22 and seal 24.

Figure 13:
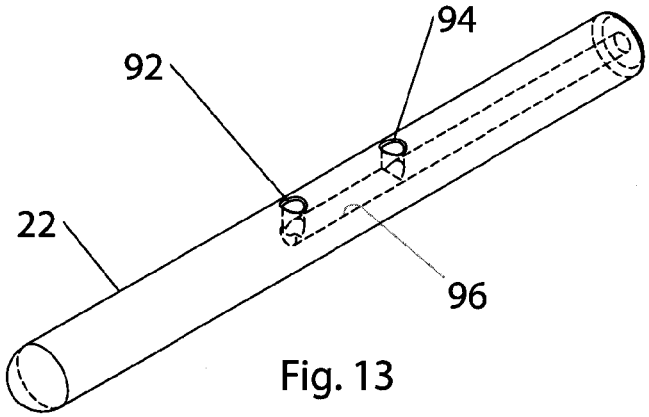
FIG. 13 is a perspective diagram of another implementation of the rod.

In another implementation, referring to FIG. 13, hollow 96 provides fluid communication between holes 92 and hole 94 to allow venting. Rod 22 seals the vent when the holes 92 and 94 are both positioned on the same side of seal 24 and rod 22 sealably contacts seal 24. Rod 22 unseals the vent when hole 92 is positioned on a different side of seal 24 than hole 94. Fluid enters hole 92 passes through to hole 94 and exits vent 18.

The position mechanism may use any material or combination of materials suitable for the particular application, for example, at least one of aluminum, electroplated aluminum, steel, stainless steel, brass, titanium, iron, copper, zinc, plastic, composite materials, and nanomaterials. The position mechanism may be of any configuration for a particular application or environment suitable for moving rod 22. For example, the position mechanism 16 may be a lever (e.g., 1502), a screw, a threaded knob (e.g., 16), a solenoid, a magnetic device, a stepping motor, a servo motor, and any other suitable device. The position mechanism 16 may be formed of a single piece of material or several assembled pieces.

In one implementation, referring to FIG. 3, the position mechanism comprises a knob 42, a knob connector 44, and a detent 46. The knob connector 44 is threadedly connected to outer shell 30 and contact rod 22. Knob 42 is connected to knob connector 44. Turning knob 42 moves knob connector 44 into and out of outer shell 30. In one implementation, the threads of knob connector 44 may be two-start threads and may enable knob connector 44 to move a greater distance into or out of body 12 with each turn. Knob connector 44 may be configured to twist as it goes into and out of shell 30 without turning rod 22.

In one implementation, the rod 22 end that interfaces with knob connector 44 may be rounded and/or have a loose fit to decrease friction between rod 22 and knob connector 44; thereby decreasing the likelihood that rod 22 will rotate with the knob connector 44. Reducing the amount rod 22 rotates may reduce wear and may increase reliability. Detent 46 may secure knob 42 and knob connector 44 in position when knob 42 is substantially close to outer shell 30. In one implementation, referring to FIG. 5, detent 46 secures knob 42 and knob connector 44 substantially in position when the rod 22 is in the on-state position.

Seal 24 and rod mount seal 36 may be of any material, size, and configuration for a particular application or environment. Seal 24 and rod mount seal 36 may use any material suitable for the purpose of sealing, for example, plastic, hemp, Teflon, butyl, polymer, plastic, polycarbonate, polyethylene, polypropylene, polyvinylchloride, and metal. Seal 24 and rod mount seal 36 may be any shape suitable for a particular configuration or environment, for example, round, annular, spherical, and a strip. In one implementation, seal 24 is a butyl o-ring configured to sealably contact rod 22. Rod mount seal 36 is a butyl o-ring configured to sealably contact outer shell 30.

Controlling the flow of pressurized liquid through on-off controller 10 may be accomplished in any manner, using any suitable apparatus, using any suitable body 12, rod 22, position mechanism 16, and seal 24. The position of the rod 22 may define any number of operating states in which the flow of pressurized fluid may be controlled in any manner. In one implementation, the position of the rod 22 defines three operating states: an on-state, an off-state, and a vent-state. The position of the rod 22 and the detent 46 may define a fourth on-locked-state. In another implementation, the position of the rod 22 defines four operating states: an on-state, an off-state, a seal-outlets-state, and a vent-state. For this implementation, the seal-outlets-state pneumatically isolates the outlets such that venting pressurized fluid from the body cavity 80 does not vent pressurized fluid from the outlets or any cavity in fluid communication with an outlet.

Figure 6:
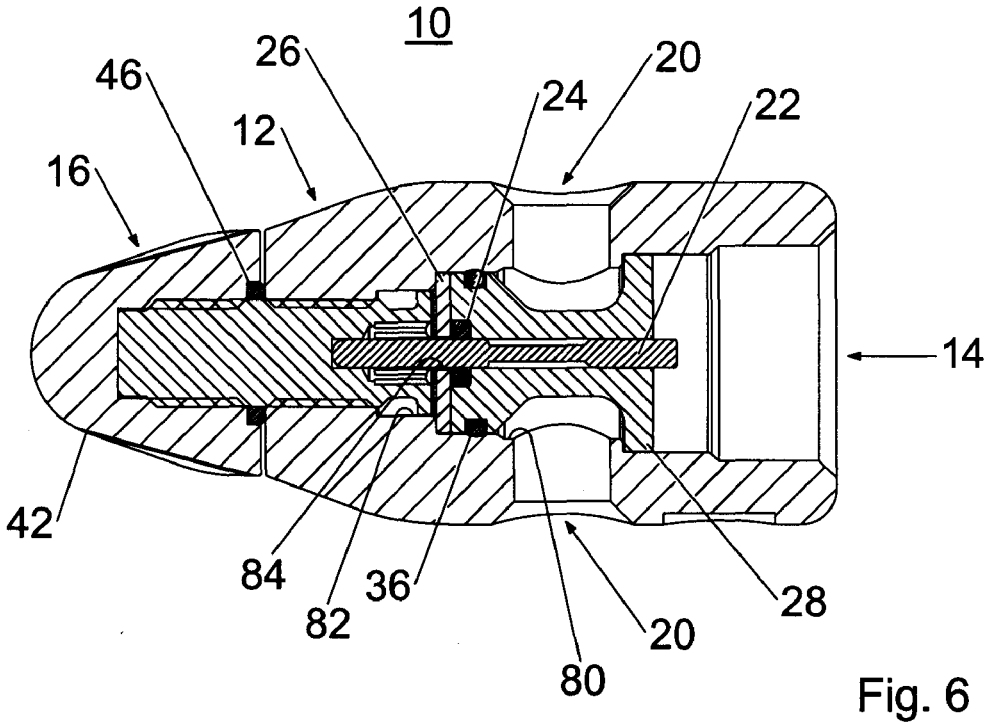
FIG. 6 is a cross-section diagram of the exemplary implementation of FIG. 1 taken along the line 6-6 with the rod in the on-state.

Placing the on-off controller 10 in an on-state may be accomplished in any manner. In an exemplary implementation, referring to FIGS. 5 and 6, on-off controller 10 is placed in the on-state when rod 22 is positioned using position mechanism 16 such that rod 22 contacts and depresses the poppet of a bottle 1802 of pressurized fluid to such an extent that pressurized fluid flows from the bottle 1804 into the inlet 14 of body 12. In an exemplary implementation configured in the on-state, vent 18 is isolated from the pressurized fluid in the body cavity 80 by the sealable contact between seal 24 and rod 22. In an exemplary implementation, the outlets 20 may be in continuous fluid communication with the inlet 14; therefore, any pressurized fluid that may enter the inlet 14 may exit at any of the outlets 20.

Placing the on-off controller 10 in an on-locked-state may be accomplished in any manner. In an exemplary implementation, referring to FIGS. 5, 6 and 10, on-off controller 10 is placed in the on-locked-state when rod 22 is positioned using position mechanism 16 such that rod 22 contacts and depresses the poppet of a bottle 1802 of pressurized fluid to such an extent that pressurized fluid flows from the bottle 1804 into the inlet 14 of body 12 and detent 46 engages outer shell 30 in such a manner as to hold knob connector 44 substantially immobile; thereby holding the on-off controller 10 in the on-state.

Placing the on-off controller 10 in an off-state may be accomplished in any manner. In an exemplary implementation, referring to FIG. 4, on-off controller 10 is placed in the off-state when position mechanism 16 is turned such that the resilient force on bottle poppet 1802 pushes rod 22 such that rod 22 no longer depresses the poppet 1802 and pressurized fluid no longer exits the bottle 1804. Additionally, in the off-state, vent 18 is isolated from the pressurized fluid in the body cavity 80 by the seal created from the sealable contact between seal 24 and rod 22. Therefore, in the off-state, body cavity 80 may retain pressurized fluid when pneumatic devices connected to the outlets 20 do not drain or decrease the fluid pressure established while the valve is in the on-state. In one implementation, the outlets 20 connect to a paintball marker 1902 through hoses. In the on-state, the fluid pressure established by the flow of pressurized fluid from the bottle 1804 may remain unchanged when the on-off controller 10 is switched to the off-state; therefore, in the off-state, the body cavity 80, the outlets 20, and the hoses connected between the outlets 20 and the paintball marker retain pressurized fluid.

Placing the on-off controller 10 in a vent-state may be accomplished in any manner. In an exemplary implementation, referring to FIG. 3, on-off controller 10 may enter the vent-state when rod 22 is positioned using position mechanism 16 such that rod 22 no longer contacts and/or depresses the poppet on a bottle 1802 of pressurized air and seal 24 no longer sealably contacts rod 22. In the vent-state, pressurized fluid in body cavity 80 passes between the seal 24 and the smaller diameter of rod 22, through vent passage 84, and out vent 18 to the atmosphere. The vent-state may also drain any pressurized fluid from any pneumatic device and/or pressurized cavities in fluid communication with outlets 20.

What is claimed is:

1. An on-off controller for controlling a pressurized fluid from a provided bottle, the bottle having a poppet valve biased in a closed position, wherein the pressurized fluid flows from the bottle when the poppet valve is open, the on-off controller comprising:

a body having a cavity, an inlet, an outlet, and a vent, the inlet and the outlet having continuous fluid communication with the cavity, the vent having sealable fluid communication with the cavity;

a seal having a seal bore therethrough, the seal for sealing the vent;

a rod having a first bore and a second bore, the first bore in continuous fluid communication with the second bore, the rod positioned in the seal bore; and a position mechanism that moves the rod to:

close the vent and open the poppet valve, wherein the first bore and the second bore are positioned on a same side of the seal, the pressurized fluid enters the inlet, and the rod sealably contacts the seal; and open the vent and close the poppet valve, wherein the first bore is positioned on a cavity side of the seal and the second bore is positioned on a vent side of the seal, the rod sealably contacts the seal, whereby the pressurized fluid in the cavity exits through the first bore and the second bore to the atmosphere.

2. The on-off controller of claim 1 further comprising a groove for coupling to a paintball marker.

3. The on-off controller of claim 1 wherein the rod is positioned axially in the body and the position mechanism moves the rod axially in the body.

4. The on-off controller of claim 1 further comprising a rod mount that positions the rod axially in the body.

5. The on-off controller of claim 1 wherein the rod loosely couples to the position mechanism, whereby a full rotation of the position mechanism results in less than a full rotation in the rod.

6. The on-off controller of claim 1 wherein the position mechanism comprises a knob.

7. The on-off controller of claim 1 wherein the position mechanism comprises a lever.

8. The on-off controller of claim 1 wherein the body comprises an outer shell, a seal ring, a rod mount, and a rod mount seal, wherein the rod mount and the seal ring each have an axial bore and are positioned axially in the outer shell, wherein the rod mount seal sealably contacts the rod mount and the outer shell, and wherein at least part of the rod is positioned in the axial bore.

9. The on-off controller of claim 1 wherein the position mechanism comprises a knob, a knob connector, and a detent, the knob connector couples to the knob and the rod, the knob connector threadedly couples to the body, and the detent contacts the knob.

10. An on-off controller for controlling a pressurized fluid from a provided bottle, the bottle having a poppet valve biased in a closed position, wherein the pressurized fluid flows from the bottle when the poppet valve is open, the on-off controller comprising:

a body having a cavity, an inlet, an outlet, and a vent, the inlet and the outlet having continuous fluid communication with the cavity, the vent having sealable fluid communication with the cavity;

a seal having a seal bore therethrough, the seal for sealing the vent;

a rod having a first bore and a second bore, the first bore in continuous fluid communication with the second bore, the rod positioned in the seal bore; and a position mechanism that moves the rod, wherein the position of the rod defines operating states comprising:

an on-state, wherein the poppet valve is open, the first bore and the second bore are positioned on a same side of the seal, and the rod sealably contacts the seal, wherein the vent is closed and the pressurized fluid enters the inlet;

an off-state, wherein the poppet valve is closed, the first bore and the second bore are positioned on the same side of the seal, and the rod sealably contacts the seal, wherein the vent is closed and the cavity maintains the pressurized fluid;

a vent-state, wherein the poppet valve is closed, the first bore is positioned on a cavity side of the seal and the second bore is positioned on a vent side of the seal, the rod sealably contacts the seal, whereby the pressurized fluid in the cavity exits through the first bore and the second bore to the atmosphere.

11. The on-off controller of claim 10 wherein the rod is positioned axially in the body and the position mechanism moves the rod axially in the body.

12. The on-off controller of claim 10 further comprising a rod mount that positions the rod axially in the body.

13. The on-off controller of claim 10 wherein the rod loosely couples to the position mechanism, whereby a full rotation of the position mechanism results in less than a full rotation in the rod.

14. The on-off controller of claim 10 wherein the position mechanism comprises a knob.

15. The on-off controller of claim 10 wherein the position mechanism comprises a lever.

16. The on-off controller of claim 10 wherein the body comprises an outer shell, a seal ring, a rod mount, and a rod mount seal, wherein the rod mount and the seal ring each have an axial bore and are positioned axially in the outer shell, wherein the rod mount seal sealably contacts the rod mount and the outer shell, and wherein at least part of the rod is positioned in the axial bore.

17. The on-off controller of claim 10 wherein the position mechanism comprises a knob, a knob connector, and a detent, the knob connector couples to the knob and the rod, the knob connector threadedly couples to the body, and the detent contacts the knob.

18. An on-off pressurized fluid system, comprising:

a paintball marker;

a bottle of pressurized fluid having a poppet valve, wherein opening the poppet valve releases a pressurized fluid from the bottle, the poppet valve biased in a closed position;

an on-off controller comprising:

a body having a cavity, an inlet, an outlet, and a vent, the inlet and the outlet having continuous fluid communication with the cavity, the vent having sealable fluid communication with the cavity, the inlet couples to the bottle, and the outlet couples to the marker;

a seal having a seal bore therethrough, the seal for sealing the vent;

a rod having a first bore and a second bore, the first bore in continuous fluid communication with the second bore, the rod positioned in the seal bore; and a position mechanism that moves the rod to:

close the vent and open the poppet valve, wherein the first bore and the second bore are positioned on a same side of the seal, the pressurized fluid enters the inlet, and the rod sealably contacts the seal; and open the vent and close the poppet valve, wherein the first bore is positioned on a cavity side of the seal and the second bore is positioned on a vent side of the seal, the rod sealably contacts the seal, whereby the pressurized fluid in the cavity exits through the first bore and the second bore to the atmosphere.

19. The on-off pressurized fluid system of claim 18 wherein the body further comprises a groove and the paintball marker further comprises a rail, wherein the rail couples to the groove thereby coupling the on-off controller to the marker.

20. The on-off pressurized fluid system of claim 18 wherein the body further comprises an outer shell, a seal ring, a rod mount, and a rod mount seal, wherein the rod mount and the seal ring each have an axial bore and are positioned axially in the outer shell, wherein the rod mount seal sealably contacts the rod mount and the outer shell, and wherein at least part of the rod is positioned in the axial bore.

* * * * *